US010668478B2

(12) United States Patent
Didion et al.

(10) Patent No.: US 10,668,478 B2
(45) Date of Patent: Jun. 2, 2020

(54) MULTI DIRECTIONAL RIFLING AND MULTI FLOW VARIABLE SPEED RIFLING FOR LINER SEGMENTS FOR CRUSHERS, RECLAIMERS, SEPARATORS AND CLEANERS FOR PRODUCTS

(71) Applicants: Mark M Didion, St. Peters, MO (US); Michael S Didion, St. Peters, MO (US)

(72) Inventors: Mark M Didion, St. Peters, MO (US); Michael S Didion, St. Peters, MO (US)

(73) Assignee: Distron Manufacturing Co., St. Peters, MO (US)

( * ) Notice: Subject to any disclaimer, the term of this patent is extended or adjusted under 35 U.S.C. 154(b) by 400 days.

(21) Appl. No.: 15/530,565

(22) Filed: Jan. 30, 2017

(65) Prior Publication Data

US 2017/0144166 A1 May 25, 2017

Related U.S. Application Data

(63) Continuation-in-part of application No. 14/121,185, filed on Aug. 11, 2014, now Pat. No. 9,757,731.
(Continued)

(51) Int. Cl.
*B02C 17/22* (2006.01)
*B02C 17/00* (2006.01)
*B02C 17/18* (2006.01)

(52) U.S. Cl.
CPC ..... *B02C 17/22* (2013.01); *B02C 17/00* (2013.01); *B02C 17/1825* (2013.01)

(58) Field of Classification Search
CPC ..... B02C 17/22; B02C 17/00; B02C 17/1825
(Continued)

(56) References Cited

U.S. PATENT DOCUMENTS 1,207,174 A 12/1916 Juhnson
2,268,661 A 1/1942 Kennedy
(Continued)

FOREIGN PATENT DOCUMENTS

DE 2262726 7/1974
DE 19718285 1/1997
(Continued)

OTHER PUBLICATIONS

English translate ES2128924, retrieved date "Mar. 17, 2019".*

*Primary Examiner* — Adam J Eiseman
*Assistant Examiner* — Mohammed S. Alawadi
(74) *Attorney, Agent, or Firm* — Paul M. Denk

(57) ABSTRACT

A multi-directional tumbling cylinder for use in concentrating or cleaning of products such as dross, salt cake, slag, carbon blocks, both, or cast or molded metal pieces, wherein the tumbling cylinder is of length, the cylinder mounted upon a base, is rotated through the operations of a motor, with the cylinder capable of turning in a clockwise or counterclockwise direction. The cylinder has an intake end and an outlet, and a series of liner segments disposed therein, that interconnect together to form an inner cylinder, and the segments have a series of rifling provided upon the inner surface, and series of vanes formed upon their outer surfaces, with the riffling and vanes having sloped lateral edges, at select degrees, to provide for controlled movement and volumetric flow of product being processed, either towards the outlet, tumbled within its midsection, moving product back towards the inlet, for regulated processing and cleaning of such product. An entrance vane provides for the prompt or slower movement of castings into the cylinder for processing during its operation.

30 Claims, 8 Drawing Sheets

Related U.S. Application Data

(60) Provisional application No. 62/388,839, filed on Feb. 8, 2016, provisional application No. 61/960,137, filed on Sep. 11, 2013.

(58) Field of Classification Search
USPC ..... 241/299, 176, 183, 170
See application file for complete search history.

(56) References Cited

U.S. PATENT DOCUMENTS

| | | | | |
|---|---|---|---|---|
| 2,743,060 | A | | 4/1956 | Daman |
| 2,885,156 | A | | 5/1959 | Wolfe |
| 2,967,671 | A | | 1/1961 | Falla |
| 3,295,772 | A | | 1/1967 | Cunningham |
| 3,595,267 | A | | 7/1971 | Anderson |
| 3,998,262 | A | | 12/1976 | Didion |
| 4,050,635 | A | | 9/1977 | Mueller et al. |
| 4,154,290 | A | | 5/1979 | Westrate et al. |
| 4,171,948 | A | | 10/1979 | Kraus et al. |
| 4,235,386 | A | | 11/1980 | Larsen |
| 4,502,808 | A | | 3/1985 | Didion et al. |
| 4,561,598 | A | | 12/1985 | Musschoot |
| 4,604,023 | A | | 8/1986 | Musschoot |
| 4,674,691 | A | | 6/1987 | Didion |
| 4,709,507 | A | | 12/1987 | Musschoot |
| 4,772,386 | A | | 2/1988 | Casey |
| 4,906,356 | A | | 3/1990 | Musschoot |
| RE33,542 | E | | 2/1991 | Musschoot |
| 5,016,827 | A | | 5/1991 | Didion |
| 5,095,968 | A | | 3/1992 | Didion |
| 5,108,589 | A | | 4/1992 | Sherman |
| 5,267,603 | A | | 12/1993 | Didion |
| RE35,331 | E | | 9/1996 | Sherman |
| 5,581,902 | A | | 12/1996 | Didion et al. |
| 5,613,902 | A | | 3/1997 | Didion et al. |
| 5,638,890 | A | | 6/1997 | Didion et al. |
| 5,752,665 | A | | 5/1998 | Wason |
| 5,794,865 | A | * | 8/1998 | Didion ..... B22C 5/0459 164/404 |
| 5,806,774 | A | | 9/1998 | Vis |
| 5,950,944 | A | | 9/1999 | Larsen |
| 5,984,105 | A | | 11/1999 | Lease et al. |
| 6,000,644 | A | | 12/1999 | Musschoot |
| 6,206,310 | B1 | | 3/2001 | Schneider |
| 6,273,176 | B1 | | 8/2001 | Didion |
| 6,431,955 | B1 | * | 8/2002 | Toschi ..... B22D 31/007 451/32 |
| 6,453,982 | B1 | | 9/2002 | Musschoot et al. |
| 6,595,267 | B2 | | 7/2003 | Didion et al. |
| 6,896,400 | B2 | | 5/2005 | Didion |
| 7,204,636 | B2 | | 4/2007 | Didion |
| 7,497,395 | B2 | * | 3/2009 | Nordell ..... B02C 17/1825 241/183 |
| 7,506,766 | B2 | | 3/2009 | Mathis, Jr. et al. |
| 7,527,153 | B2 | | 5/2009 | Lease et al. |
| 7,735,653 | B2 | | 6/2010 | Musschoot et al. |
| 7,942,354 | B2 | | 5/2011 | Didion |
| 7,954,644 | B2 | | 6/2011 | Lease et al. |
| 8,245,962 | B2 | | 8/2012 | Didion |
| 8,544,782 | B2 | | 10/2013 | Musschoot et al. |
| 8,622,330 | B2 | | 1/2014 | Mepham |
| 2002/0023729 | A1 | | 2/2002 | Didion et al. |
| 2005/0116077 | A1 | | 6/2005 | Herbst et al. |
| 2014/0150524 | A1 | | 6/2014 | Magne |
| 2014/0203129 | A1 | * | 7/2014 | Williams ..... B02C 17/225 241/183 |
| 2015/0069159 | A1 | | 3/2015 | Didion |
| 2015/0283549 | A1 | | 10/2015 | Malmqvist |

FOREIGN PATENT DOCUMENTS

| | | |
|---|---|---|
| EP | 0714703 | 5/1996 |
| EP | 1018368 B1 | 6/2006 |
| ES | 2128924 | 1/2000 |
| RU | 2284861 C1 | 10/2006 |
| WO | WO 2008/011231 | 1/2008 |
| WO | WO 2012/171825 A2 | 12/2012 |

* cited by examiner

MULTI DIRECTIONAL RIFLING AND MULTI FLOW VARIABLE SPEED RIFLING FOR LINER SEGMENTS FOR CRUSHERS, RECLAIMERS, SEPARATORS AND CLEANERS FOR PRODUCTS

CROSS REFERENCE TO RELATED APPLICATIONS

This application is the non-provisional application of the application having Ser. No. 62/388,839, filed on Feb. 8, 2016, and this application is a continuation-in-part of the patent application having Ser. No. 14/121,185, filed on Aug. 11, 2014, and which application is a non-provisional of the provisional patent application having Ser. No. 61/960,137, filed on Sep. 11, 2013.

FIELD OF THE DISCLOSURE

This disclosure generally relates to a tumbling unit, usually formed of interlocking liners, and more particularly concerns the formation and usage of contoured rifling and vanes within the tumbling cylinder and which provide for the controlled movement of product and the removed debris and fines in select directions, regardless whether the tumbling cylinder is rotated in a clockwise or counterclockwise direction of movement during its operations.

BACKGROUND

There are many tumbling units, crushers, casting shake-out units, that have been designed, manufactured, and marketed, in the past. These devices fit the category of rotary lump crushers, sand reclaimers, rotary slag separators, metal reclaimers, casting/sprue cleaners, and related types of machines. These machines run continuously, or by batch operation, depending upon their applications. Many of these types of machines have been invented by the family of Didions, as can be seen from their various United States patents as identified herein. These patents include U.S. Pat. No. 3,998,262, upon A Casting Shake-Out Unit and Method of Operation. Other related patents include U.S. Pat. No. 4,502,808, upon Liner Segments Retention Means. U.S. Pat. No. 4,674,691, discloses a Dual Sand Reclaimer. U.S. Pat. No. 5,095,968, shows a Rotary Media Drum With Cooling Components. U.S. Pat. No. 5,016,827, shows a Sand Reclaiming Drum. A further U.S. Pat. No. 5,267,603, discloses a Sand Reclaiming Drum With Media Recycler. The U.S. Pat. No. 5,638,890, shows the Interlocking Liner For A Casting Shake-Out Unit. U.S. Pat. No. 5,794,865, discloses the Rotary Media Drum For Reclaiming and Reclassifying Sand and Related Aggregates From Lump Materials. U.S. Pat. No. 5,613,902, shows the Improved Sand Reclaimer. U.S. Pat. No. 5,581,902, discloses the Rotary Dryer Drum. U.S. Pat. No. 6,273,176, shows the Interlocking Liner for A Casting Shake-Out Unit. U.S. Pat. No. 6,595,267, discloses the Liner Lock Key For A Tumbler Liner Segments. U.S. Pat. No. 6,896,400, shows the Granular Product Cooling and Blending Rotary Drum. U.S. Pat. No. 7,204,636, is upon the Granular and Aggregate Product For Blending, Cooling and Screening Rotary Drum. U.S. Pat. No. 7,942,354, discloses the Rotary Tumbler and Metal Reclaimer. And, U.S. Pat. No. 8,245,962, once again, shows a Rotary Tumbler and Metal Reclaimer. These are examples of the variety of developments that have been made by some of the inventors herein, upon various types of tumbling units, principally used in the casting, mining, and related industries.

Many other types of tumblers are also available in the art, as shown in their various patents. Examples of these can be seen in the U.S. Pat. No. 4,050,635, upon the Method and Apparatus for Reclaiming Sand.

The U.S. Pat. No. 5,806,774, shows a Centrifugal Impact Crusher.

U.S. Pat. No. 5,950,944, to Larsen, shows a Laminar Mill Liner.

The patent to Musschoot, U.S. Pat. No. 8,544,782, shows another Liner for Drum and Method of Assembly. Another patent to Musschoot, et al., U.S. Pat. No. 6,453,982, shows a Sand Cleaning Apparatus. A tumbling apparatus is shown in the Patent to Musschoot, No. RE. 33,542. A further patent is shown in U.S. Pat. No. 4,561,598, upon an Apparatus for Grinding, Milling, Crushing, Scrubbing, Sizing and/or Classifying Material. These are all examples of various types of materials classifying systems, that are available in the prior art.

SUMMARY OF THE DISCLOSURE

The present disclosure contemplates the formation of a tumbling unit which because of its unique design and construction, can extend the life of current tumblers, sand reclaimers, casting shake-outs, by twice that of the prior devices. This unit comprises a cylindrical member, having an inner surface, an outer surface, an inlet end, and outlet end, and generally is mounted for rotational movement upon a bearinged base. In the first embodiment, the unit is of a singular cylinder design. In the second embodiment, the unit may have, and be formed of, a pair of inner and outer cylindrical members. As known in the art, the inner cylinder functions to tumble and product delivered therein at its inlet end, break free any mold sand, debris, oxides, or any other deleterious particles that need to be removed, so that the metallics can be reasonably cleaned and clear of any barbs, or any unwanted burrs, casting linkages, or the like. Where a double cylindered design is applied, such debris, or the removed mold sand, as tumbled free, passes through the perforated interior cylinder, and into the outer cylinder, where it is moved by vanes either down stream, or back towards the inlet end, for eventual collection and/or disposal. In the case of a mold sand, since such sand is expensive to purchase, its cleaning and reusing is highly desirable in the sand casting art.

Frequently, the inner cylinder will be formed of liner segments, which will have the interior rifling, that moves the metallics, integrally formed upon their interior surfaces, while the vanes may be integrally molded extending outwardly from the liner segments, so that when the segments are inter-fitted together, to form the interior cylinder, the rifling will be disposed for movement of the castings, sand lumps, slag lumps, carbon blocks, and both, while the vanes disposed intermediate the outer surface of the liner segments, and the inner surface of the outer cylinder, will move the sand, oxides or debris one way or the other, as required from the operations of the tumbling or shake-out unit.

It is further just as likely that the formed rifling may be secured by fasteners, welding, or the like, to the inner surface of the main cylinder, to provide for their functioning in the movement of the metallics, or the like. Or, the rifling that is operatively associated with the inner cylinder may likewise be formed on the liner segments, with the rifling integrally extending inwardly therefrom, and a series of cast or fabricated segments can be laid against the interior of the inner or main cylinder, to form a circumferential liner segment exposing its rifling within the interior of the main cylinder, to function to move product and tumble such, during application.

The uniqueness of the current invention has to do with the contoured structure of the various rifling, these multi-cylindered located vanes, and the entrance vane that is utilized within the structure of this tumbling unit. For example, the rifling is contoured and shaped to provide for their functionality in moving the disposed product or metallics along the main cylinder, in selected directions, whether it be towards the outlet end of the cylinder, or in certain instances, towards the inlet end of the cylinder, or to move the product from approximate the outlet end and back into the center of the cylinder, to undertake further tumbling of the product or castings applied therein, to assure that complete cleansing takes place, upon the applied metallics or castings, before they exist out of the outlet end of the said main cylinder.

The concept of this invention is the provision of a new multi-directional and multi-flow variable speed rifling that can provide for the controlled movement, in select directions, regardless whether the tumbling cylinder is rotated in a clockwise or counterclockwise direction. Thus, heretofore, almost all tumbling units would rotate in simply one direction. Thus, when the various rifling and vanes would wear out, because of enduring usage, the liner segments would require expensive replacement. When you stop to consider that the same rifling can now be used with the tumbling unit, or its main cylinder, when it is being also turned in a counterclockwise direction, and achieve movement of the product therein, this extends the life of the tumbling unit to double, from what was done previously. This is the primary essence of the current invention.

In addition to the foregoing, this multi-directional rifling and multi-flow/variable speed lining, of the cylinder(s) where product can flow in the same direction by rotating the drum or cylinder clockwise, or counterclockwise, is the primary enhancement of this invention. This allows the main product discharge to be at the opposite end from the intake end, regardless of which way the drum or cylinder turns. This is accomplished by forming a series of truncated semi-chevron shaped rifling, having lands or contoured surfaces on either side of the rifling, so that when the main cylinder is turned in one direction, the rifling will force the product to flow in the direction of the rifling slant, and when the main cylinder is turned in an opposite direction, the slanted surface on the opposite side of each rifling will force the product to also flow in a controlled or some direction, during overall usage of the tumbling unit of this invention. There are a plurality of such riflings located within the main cylinder, and the contoured side surfaces of each of said plurality of rifling can be symmetrical, asymmetrical, having different integral slants along their sides, or can be a combination of both, depending upon the product characteristics, the retention time required, the desired volumetric flow rate, as when the tumbling unit is operated.

With the symmetrical type of pitch rifling, for example, where both sides can be at a seven degree slant towards the outlet end of the main cylinder, the flow rate can be the same in either direction of rotation, both clockwise and counterclockwise, and with the asymmetrical type of design applied to the rifling, on either side, as an example, where one side of the rifling may have a 7° pitch on one side, while the opposite side of the rifling may have a 15° pitch, as on its opposite side, so that depending upon the rotation of the main cylinder, the product can be moved more promptly when urged by the 15° pitch side of the rifling, than when the cylinder is rotated in an opposite direction, and the product encounters the 7° pitch side of the rifling, as on its opposite side. This arrangement can significantly change, the flow rate simply by changing the drum or cylinder rotation. The design can also have a 0° pitch on one side of the rifling, and a 7° pitch on the other side, so that there is neutral or no flow when the drum is rotated in one direction, such as when it is desired to continue the tumbling of the product or castings at the center segment of the main cylinder, and when sufficient tumbling has occurred, and when you reverse the rotation of the drum, the product will flow forwardly and out of the outlet end of the cylinder at it encounters the 7° pitch. In some cases, one may have a different or several pitches of the rifling in the same machine, to accomplish many different movements and retention time for the product delivered therein. For example, in a first section of the main cylinder, and entrance vane can be installed, and the vane may have a 65° pitch on one side, and a 15° pitch on the other side of the truncated semi-chevron shaped vane. The next section, or the center section of the main cylinder, may have 0° contour on one side of the rifling, for neutral action or no push of product to enhance retention time, and have a 7° pitch on the other side of the rifling, so that when you reverse the rotation of the cylinder, the product moves forwardly, towards the outlet end of the main cylinder. Then, in the last section of the main cylinder, there may be a 7° reverse pitch provided on one side of the rifling, so as to push the product and castings back towards the middle section for tumbling, but that when you reverse the rotation, it pushes the cleaned product forwardly, for further tumbling and out of the outlet end of the main cylinder.

It is an important object of this invention to obtain a desired or different retention time of product or castings within the cylinder, depending upon which way the main cylinder or drum is rotated. Where you have product like dross, salt cake, slag or metal pieces that need to be concentrated or cleaned, you can rotate the drum in one direction to establish a certain retention time, and after the aggregate or product is concentrated or cleaned at its fixed location, one simply changes the rotation of the main cylinder to discharge the product out of the outlet end, at a desired rate.

Another unique aspect of this invention is that not only may the foregoing rifling be used within the main cylinder, but where dual chamber drums are provided, such as incorporating the inner or main cylinder, within an outer drum or cylinder there may be contoured vanes between said inner and outer cylinders, within the dual chamber lining design, that provides for the fine materials such as sand, debris, or the like, to be removed at where ever the discharge for the outer cylinder is located. These intermediate vanes between the inner and outer cylinders may also be contoured, to move the sand or debris in the desired direction for disposal or collection, regardless whether the tumbling unit is rotated in a clockwise or counterclockwise direction. With both the single cylinder and dual cylinder lining designs, and with the series of symmetrical, asymmetrical, or compounded truncated semi-chevron shaped rifling can be used, complete control of and disposal of debris product may be maintained. This is an important aspect and unique feature for the contoured rifling and vanes of this invention, which can be initially fabricated into various liner segments, or cast in one piece, having the rifling integrally formed upon their inner surfaces, and the contoured vanes formed upon their outer surfaces, so that such liner segments can be linked together, to form the inner cylinder, within an outer cylinder, particularly when the dual chambered tumbling unit is fabricated for usage.

Another aspect of this invention is the inclusion of an entrance vane that may be provided at the intake end of the cylinder section, with the entrance vane being provided for furnishing quick or controlled movement of product into the inner cylinder, to commence a cleaning or other operation, through its usage. For example, said entrance vane may have at least one face having a contour that urges product faster and further inwardly of the main cylinder, while the product is being delivered thereto. One face of the vane, for example, may be formed at a 5 to 15° pitch with respect to the longitudinal axis of the main cylinder, and thereby provide for a slow delivery of product within the main cylinder, through its urging. Or, said entrance vane may have another face extending angularly longitudinally within said cylinder, and this face may be within the range of 50 to 75° off of the longitudinal axis of the cylinder, and thereby provide for a more rapid pushing of deposited product within the main cylinder, towards its first and second sections, for rapid processing of the products or castings, by the cylinder. Obviously, the two faces of the entrance vane will selectively come into operation depending upon which direction of rotation the tumbling unit undertakes. For example, if the unit is rotated in a clockwise direction, then the product will be forced inwardly of the main cylinder more rapidly by the higher angled face of the entrance vane. But, if the tumbling unit is rotated in a counterclockwise direction, then the product will be urged forwardly into the main cylinder by the lessor angled face, at a much more slower pace or volume due to its lower angled relationship with the axis of the said main cylinder. These are just examples as to how the structure of this device can be calculated, fabricated, and operated, in either direction of rotation, depending upon the angled contours that are structured into the entrance vane, the rifling, or the intermediate vanes between the dual cylinder unit, as previously reviewed.

Furthermore, where the rifling is fabricated and cast into liner segments, and the intermediate vanes likewise are cast with the liner segments, the various rifling, or vanes, can be applied either centrally of the liner segments, or along their end edges, and in the latter instance, will conveniently mate with similar rifling or vanes provided upon the next adjacent liner segments, as they are installed for forming the circumferential inner cylinder extending along the length of its tumbling unit, during manufacture.

As also previously reviewed, this new type of shaped lining, incorporating the rifling and vanes, can be used in the rotary lump crushers, in sand reclaimers, in rotary slag separators/metal reclaimers, casting/sprue cleaners, and casting shake-out units. These machines can run continuously, or by batch operation, depending upon the application involved.

It is, therefore, the principal object of this invention to provide a tumbling unit that can be operated in either direction of rotation.

A further object of this invention is to provide a tumbling unit that has an extended life twice that of prior art type of tumblers, due to its unique ability to function both when rotated in a clockwise or counterclockwise direction.

Still another object of this invention is to provide a tumbling unit having unique rifling applied either to the interior of the main cylinder for the device, or to the liner segments that are applied to the inner surface of main cylinder, or to the liner segments that make up the inner cylinder, wherein the rifling segments have contoured faces, on either side, to provide for controlled movements of product delivered into the tumbling unit during its application and usage.

Still another object of this invention is to provide a tumbling unit wherein contoured rifling can provide for movement of product towards the outlet end of the unit, when rotated in one direction, or provide for reverse movement of product within the main unit when it is rotated in an opposite direction, or simply hold the product stationary within one of the sections of the tumbling unit, to provide for sustained tumbling and cleaning of metallics during their processing within the tumbling unit.

Still another object of this invention is to provide contoured vanes that may locate intermediate the main cylinder and outer cylinder of a dual chambered tumbling unit, that can also provide for controlled movement and removal of sand, oxides or debris depending upon the direction of rotation of the tumbling unit during its operations.

Still another object of this invention is to provide an entrance vane within the entrance segment of the main cylinder of a tumbling unit, and which may have one or more contoured surfaces to control the time and volume of product urged into the various sections of the main cylinder, during its operations.

Still a further object of this invention is to provide for contoured rifling, and contoured vanes, that can be fabricated or integrally cast with the liner segments when formed in preparation for their installation for forming the main inner cylinder of a tumbling unit.

These and other objects may become more apparent to those skilled in the art upon reviewing the summary of the invention as provided herein, and upon undertaking a study of the description of its preferred embodiments, in view of the drawings.

BRIEF DESCRIPTION OF THE DRAWINGS

In referring to the drawings:

FIG. 1 provides an isometric view of a tumbling unit of this invention, comprising a sand reclaimer, casting shake-out, or the like;

DESCRIPTION OF PREFERRED EMBODIMENTS

The concept of this invention, as previously summarized, is generally the provision of various machines that process castings, products, or other components, generally to provide for their cleaning, such as for the removal of mold sand from castings, at the foundry, the cleaning and reclaiming of mold sand in preparation for further usage, or for processing slag, dross, other metal pieces, as known in the art. The applicants herein have obtained a variety of patents upon their significant innovations in this particular art, and these types of machines can be seen in the various patents to Didion, as reviewed in the Background of the Invention. These machines are substantially large, they can be anywhere from 15 to 70 feet long, 4 to 14 feet in diameter, and when operated, normally run continuously, to attain the results as previously described.

Figure 1:
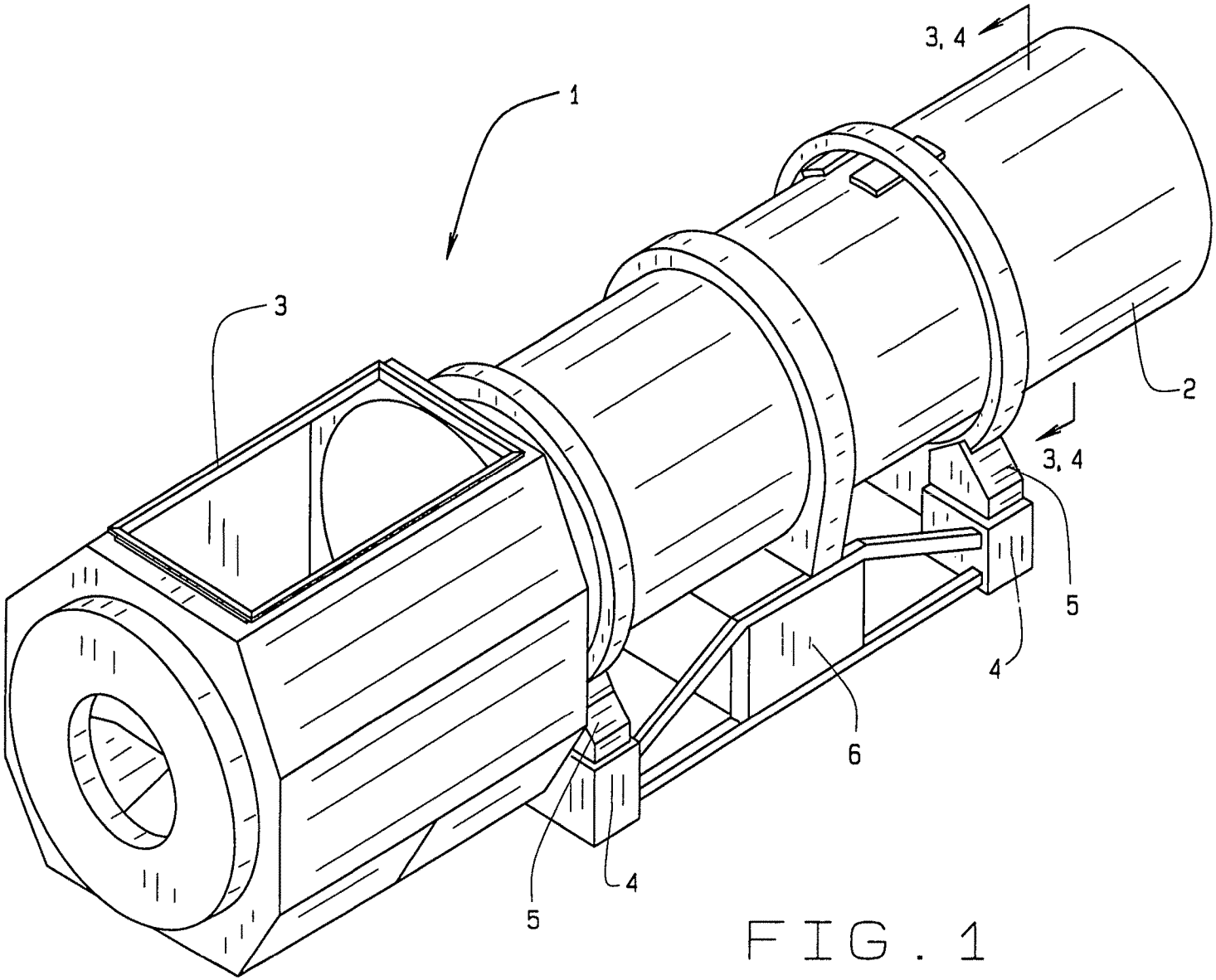

An example of one such machine is shown in FIG. 1, wherein there is shown a sand reclaiming drum 1 as known in the art. This particular drum includes its main cylinder, as at 2, and has a fines or dust collector, as at 3, at its front end, as noted. It operates upon a base 4 and has a series of roller bearings, as at 5, to accommodate its rotation. A motor is normally contained at 6, to attain rotation of the cylinder 2.

As well known in the prior art, the operation of these machines normally is in a singular direction of rotation, usually clockwise, continuously, as stated, until the components would wear out, such as the cylinder or liner segments contained within the cylinder 2, at which time these components would require repair or replacement. But, the essence of this invention is that the various rifling, vanes, and other components that process the castings within the cylinder are formed and adapted for allowing the processing of product when the cylinder is rotated even in the opposite direction, such as a counterclockwise direction, and therein provides for a double time usage in the operations of the machine, so that when it appears that the machine may be wearing out when rotated in one direction, it simply can be rotated in the opposite direction, and extend the useful life of operation of the machine for twice the time. Hence, it can be seen that this machine, of the new design, when operated for cleaning product, can be rotated in a clockwise direction for some time, and then reversed and continued to be operated in the counterclockwise direction, and these may be alternated in usage until such time as it appears that the cylinder or liner segments are uniformly wearing out, and at that time, and require replacement. Thus, the life of operation of the machine is doubled, which is of real benefit and cost savings to the user, and delays necessary repairs, until a much later time.

Figure 2:
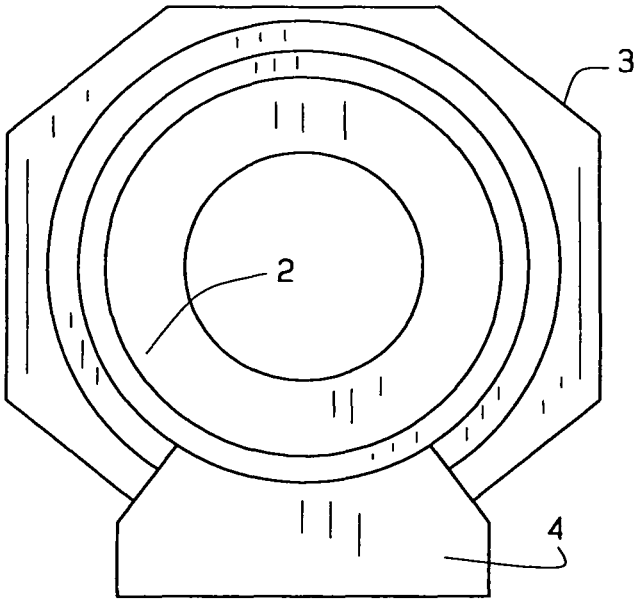
FIG. 2 is an end view of the inlet end of the unit of FIG. 1.

FIG. 2 provides an inlet end view of the unit as disclosed in FIG. 1.

Figure 3:
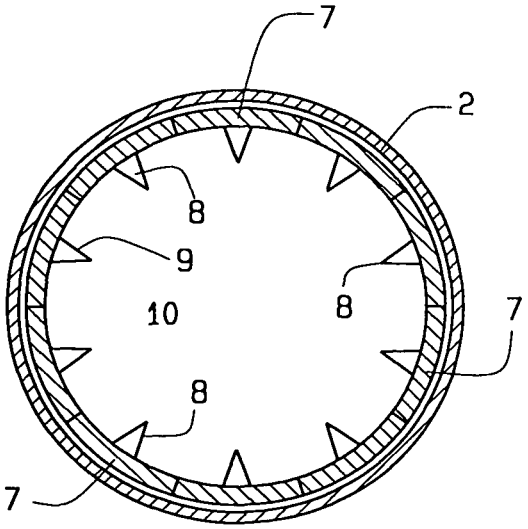
FIG. 3 is a sectional view of a main cylinder tumbling unit taken along the line 3-3 of FIG. 1.

The invention herein, generally, can be seen in FIG. 3. The cylinder 2 contains a series of liner segments 7, which when assembled circumferential interior within the cylinder 2, form an interior cylinder having a series of integral rifling 8 therein, and as will be subsequently described, it can be seen that these rifling have sloped surfaces, as at 9 and 10, as will be subsequently analyzed, and these rifling are provided for tumbling, moving, and generally processing any castings, sand, or products that are introduced through the inlet end of the tumbling unit, in preparation for their further processing. The various lateral faces 9 and 10 are unique to the operations of this device, and will be subsequently analyzed in greater detail, as to how they are formed, what type of contours the sides of the rifling may have, in order to achieve their intended purposes. Nevertheless, as can be generalized upon reviewing FIG. 3, since the rifling appears to be of uniform construction to either side, or having a particular slanted design, it can be understood that the tumbling unit can be turned in either a clockwise or counterclockwise direction, for processing of the castings and other products located within the tumbling unit during its operations.

Obviously, while the rifling is shown as being formed upon the liner segments 7, it is likely that these rifling could be otherwise attached, or welded to the interior of the main cylinder 2, and still function in the manner as described for the operations of this invention. But, in the preferred embodiment, generally the rifling will be formed integrally upon liner segments, so that when there is a wear out of these components, the liner segments can be replaced, as has been known in the art, and as can be determined from review of the prior Didion patents as described herein.

Figure 4:
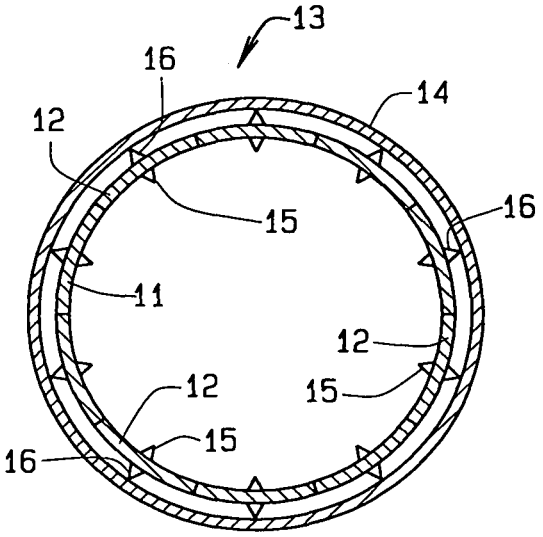
FIG. 4 is a sectional view of a modified dual cylinder tumbling unit of this invention, taken along the line 4-4 of FIG. 1.

The concept of the invention can also be used with dual or multi-cylindered tumbling units. FIG. 4 shows a dual chamber, wherein the main cylinder 11, which can be formed of various liner segments 12, as previously reviewed, in this particular instance, forms the inner cylinder for the tumbling unit 13. Then, an outer cylinder 14 holds the liner segments 12 in position, within the outer cylinder 14, and these liner segments not only include the inner rifling 15 as previously described, but further is formed having the contoured vanes 16 that when the inner cylinder is formed, they rest upon the interior of the outer cylinder 14, in their assembly. Hence, product that is delivered through the inlet end 2 of the unit will be processed and cleaned within the inner cylinder 11, through the tumbling action achieved through its rotation, and when the castings encounter the rifling 15, such can either move the castings along the cylinder, during its operation, or move the castings in an opposite direction, or simply stationarily tumble the castings usually at the mid point of the tumbling unit, during its operations.

As will be subsequently shown, the tumbling unit, particularly within its interior, may have various sections along its length. One section may provide for initial tumbling of the castings, as they enter into the tumbling unit, a midsection may have more stationary type of rifling, that tumbles the castings in place, but does not significantly move them along the tumbling unit, and then the end section of the cylinder 2 or 11 may either further tumble the castings, to provide them with a final cleansing, or the rifling may be oriented to move the castings out of the tumbling unit, or the rifling may be contoured to move the castings back into the midsection of the unit, for further tumbling and their cleaning. These are just examples of the versatility of the structure of the fabricated tumbling unit, and how it may be multi-operational to process that type of castings, products, or sand that are being processed at the customer's plant, and which can further be operated in either a clockwise or counterclockwise direction, to enhance the useful life of the tumbling unit, over its lengthy continuous operations.

Figure 5:
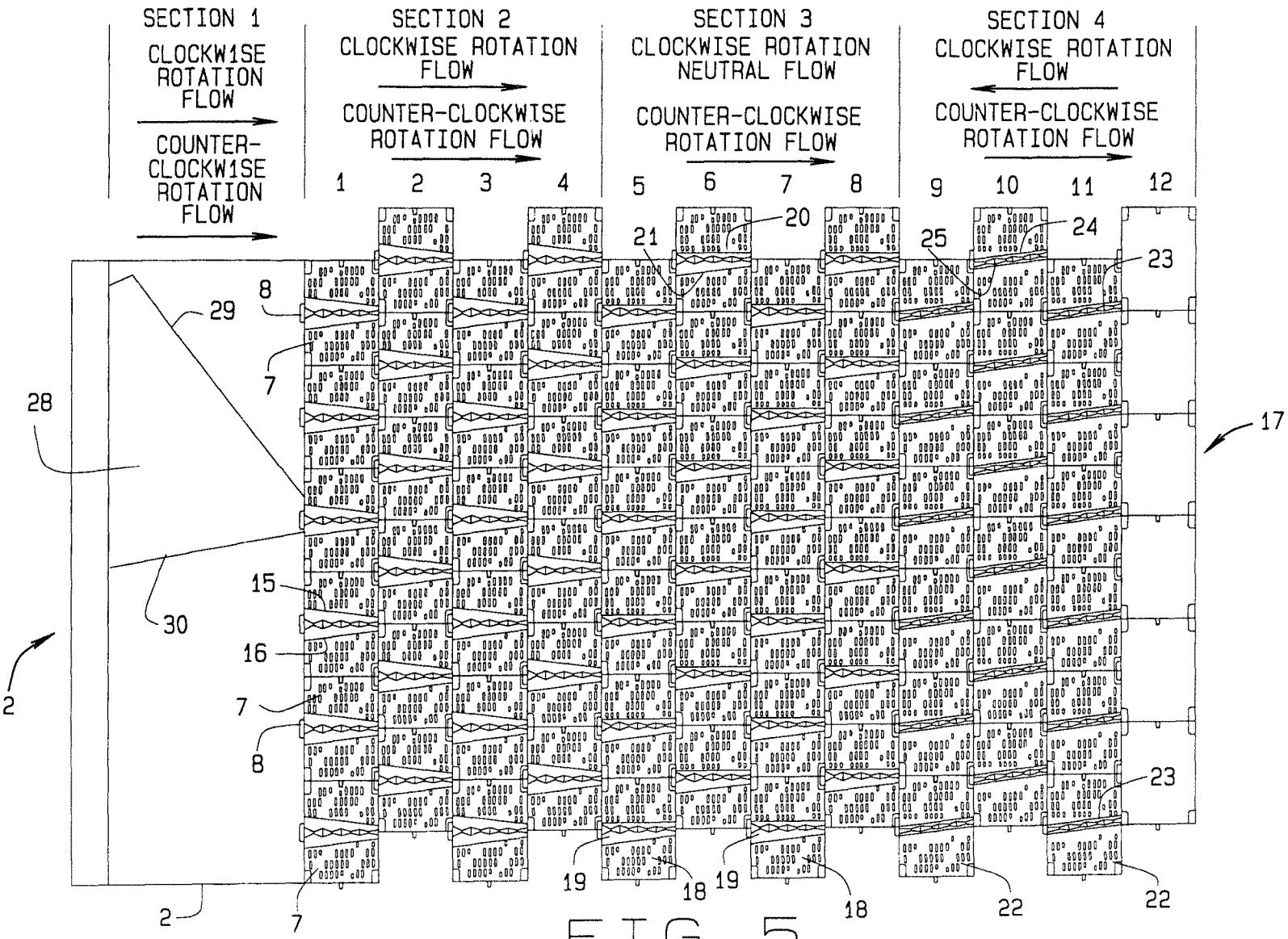
FIG. 5 is a plan view taken along the center of the tumbling unit of FIG. 1, showing the entrance vane and contoured rifling liner segments of the main cylinder.

To provide further details relating to the formation of the various rifling 8 and 15 of this invention, reference is made to FIG. 5. As can be noted, each liner segment 7 has at least an integral rifling 8 provided thereon, and which extends interiorly of the cylinder 2. As can be seen, each of these rifling has a sloped lateral surface, as at 15 and 16, which are contoured angulating inwardly, towards the outlet end 17 of the formed cylinder. As noted, the angle of inclination of these rifling contoured surfaces 15 and 16, at the second section of the cylinder are angled inwardly, approximately 7° each, in their formation. Thus, any castings or products deposited into the inlet end of the tumbling cylinder, will gradually be moved to the right, further inwardly of the formed cylinder, and towards its outlet end 17. This is regardless whether the cylinder is rotated in a clockwise or counterclockwise direction of rotation.

As then can be seen in section 3 of the cylinder, which is the midpoint section of the cylinder, each liner segment 18 has an integral rifling 19 provided thereon. But as can be seen, the contoured sides of these riflings, as noted at 20 and 21, have different slopes. The surface or side 20 is straight, and does not incline with respect to the longitudinal axis of the cylinder. The opposite side 21 is formed at the same angle of 7°, and thus, as can be noted, for this midsection or section 3 of the tumbling unit, when the unit is rotated in a clockwise direction, the side 20 of each rifling, which has no contour to it, will simply tumble the castings or product continuously in place within this central section of the cylinder, during its operations in that direction of rotation. But, should the cylinder be reversed in its rotation, or turned in a counterclockwise direction, then the castings will encounter the sloped sides 21 of the rifling within this midsection of the cylinder, and have a slow flow rate towards the outlet end 17 of the tumbling unit. Thus, if the operators know that the castings need substantial tumbling to provide for their cleansing, then he/she will rotate the cylinder for some time in the clockwise direction of rotation. And, when they believe that the castings are sufficiently cleaned, they simply can reverse the rotation of the cylinder, into a counterclockwise direction of rotation, in order to urge the castings down stream of the cylinder and towards the outlet end 17.

As can be seen in what is identified as the section 4, or end section of the cylinder, there are likewise a series of liner segments 22 provided. The rifling provided at this section, as seen at 23, have additional sloped contours 24 and 25, as noted. In this instance, since these contours are approximately 7° off the longitudinal axis of the cylinder, when the unit is rotated in a clockwise direction, the castings will encounter the contoured side edge 24 of the shown rifling. In this instance, the castings will be moved back towards the center section 3, of the cylinder, for further tumbling therein. But, when the cylinder is rotated in a counterclockwise direction, the castings will encounter these contoured surface 25 of the rifling, and be urged towards the outlet end 17 of the unit, for completion of their tumbling process.

Thus, as can be readily understood, it can be seen how the control of movement of the castings or products being cleaned through the tumbling unit can be regulated by the surface contour of the various riflings provided therein when the interior of the cylinder is formed from the plurality of liner segments 7, 18, and 22. Obviously, the degree of contour of the sides of each of these rifling can be at any angle as required by the manufacturer in the usage of the tumbling unit within the plant. These contours may be at any select degrees, whether it be at a 0°, as noted for the lateral contour 20 for the rifling at the midsection of the cylinder, or at a 7° slant, as noted at 15 and 16 for the intake section, or section 2 of the cylinder, or may have slope as noted for the sides 24 and 25, of the rifling, as previously explained. These slopes may be at any angle, whether it be at 5, 10, or 15 degrees off the longitudinal axis, in order to attain the required volume-metric flow of the castings, the amount of time that it is desired to have the castings remain in the tumbling unit, in order to achieve the degree of cleansing as desired. The particular slope and configuration for the rifling, and for that matter, the integral vanes provided upon the outer surface of the liner segments, will be analyzed in greater detail subsequently.

Figure 11:
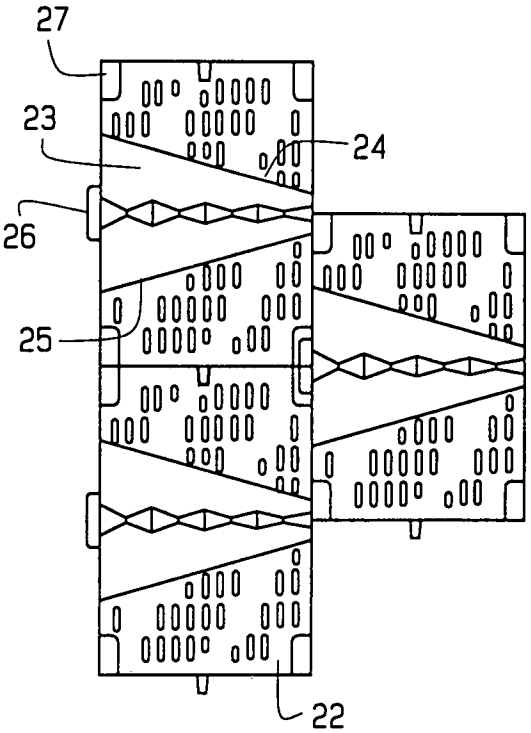
FIG. 11 is a view of a plurality of liner segments showing the multi-contoured rifling of greater angular slant being formed centrally of each of the shown segments.
Figure 10:
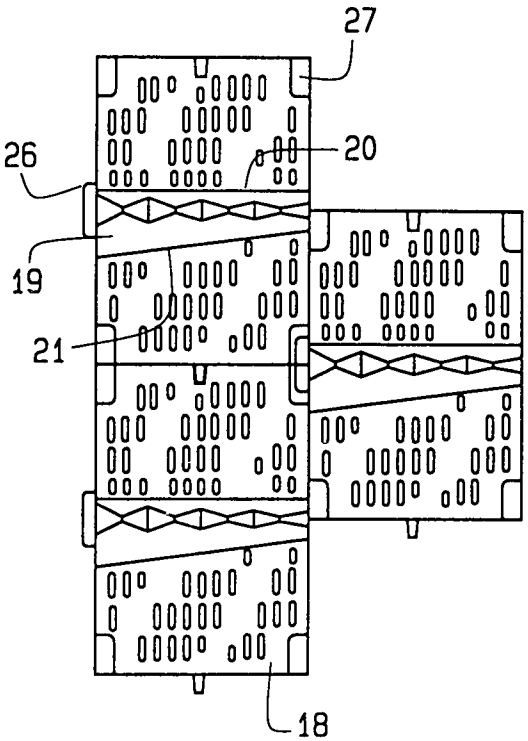
FIG. 10 is a view of a plurality of a the liner segments showing the contoured rifling having only one contoured surface on a side of each shown rifling.
Figure 9:
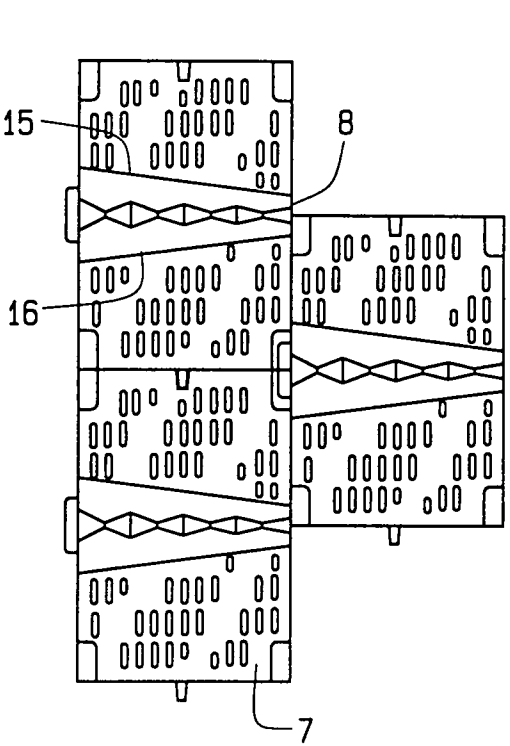
FIG. 9 provides a view of a plurality of liner segments showing a double contoured rifling formed centrally of each of the shown liner segments.

FIGS. 9, 10, and 11 provide a slightly enlarged views of the various liner segments, such as for the section 2, section 3, and section 4 for the formed cylinder, and how there are various contoured side surfaces for each of the rifling, for the purposes as previously described. In FIG. 11, it can be seen that the contour of the rifling, along the lateral side edges, are to a greater degree, and in this particular instance may be as great as 15° on each side, such as at the outlet end of the cylinder, in order to provided for an aggressive push of the cleaned castings or product from the tumbling unit, after completion of a tumbling cycle. Obviously, these various types of liner segments, with their contoured rifling, could be located at various sections within the formed cylinder, depending upon the speed at which the castings are desired to be moved through the tumbling unit, during their processing. As can further be seen, and as noted in prior Didion patents, these liner segments are inter-connectable together, usually staggered in their connected relationship, through the usage of various tongues 26 and grooves 27, when the liner segments are inter-fitted together, to form a circumferential liner within the main cylinder for the tumbling unit.

Figure 8:
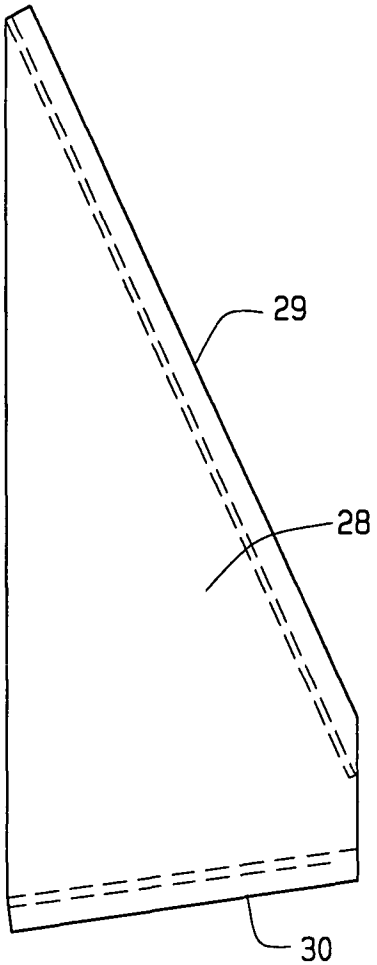
FIG. 8 provides a plan view of the entrance vane and its various angled sides.
Figure 7:
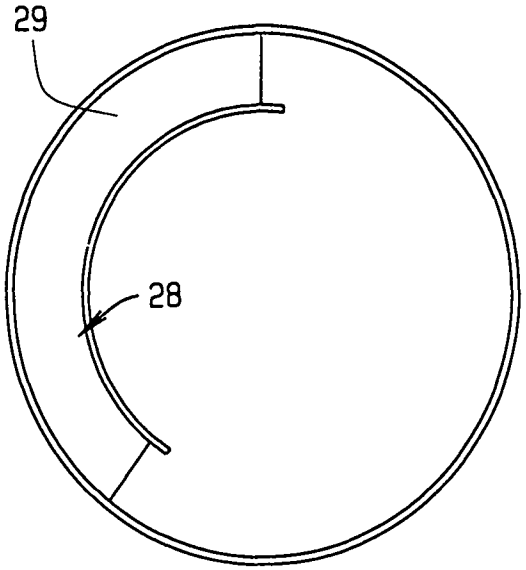
FIG. 7 is a sectional view looking towards the inlet end showing the entrance vane of this invention.
Figure 6:
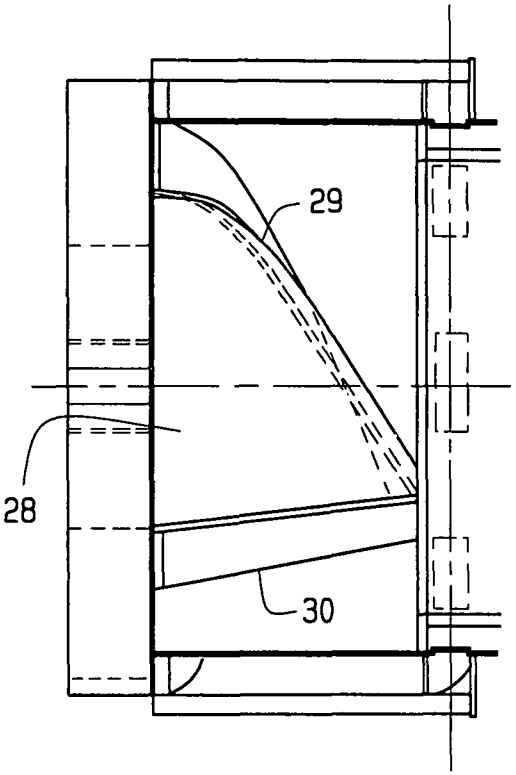
FIG. 6 is a plan view of the entrance vane of the tumbling unit of this invention.

As can also be seen in FIG. 5, there is an entrance vane, as at 28, provided at the inlet end 2 of the cylinder of the tumbling unit. The purpose of this entrance vane is to provide for, in addition, a controlled movement of castings or other products to be cleaned into the tumbling unit initially. As noted, and as further can been in FIGS. 6-8, the entrance vane 28 also has a pair of contoured edges 29 and 30. The contour 29 is at an approximate 65° pitch, such that when the cylinder is rotated in a clockwise direction, it provides for an accelerated flow of the castings into the main cylinder of the tumbling unit. Obviously, this degree of pitch can be to any angle, anywhere between 30-75 degrees off of the longitudinal axis of the cylinder, in order to provide for that quick flow of the castings into the unit for processing. The opposite contoured edge 30 may be at a lesser degree of slope, off of the longitudinal axis, and while it is shown at an approximate 15° angle, it also could be of a lesser angle, or greater, to provide for a slower urging of castings into the cylinder, which once again depends upon the capacity that the tumbling unit can process, at any given time, and how fast the castings need to be urged into the cylinder, for a cleaning operation. Thus, when the unit is turned in a clockwise direction of rotation, then the surface 30 acts upon the entering castings, and urges them at a lower volume and slower pace into the tumbling unit, during its functioning. The degree of slant for the surface 30 could be, more or less, below 5° to 20°. These FIGS. 6-8 show the location of the entrance vane 28 at the inlet end for the main cylinder of the tumbling unit.

Figure 12:
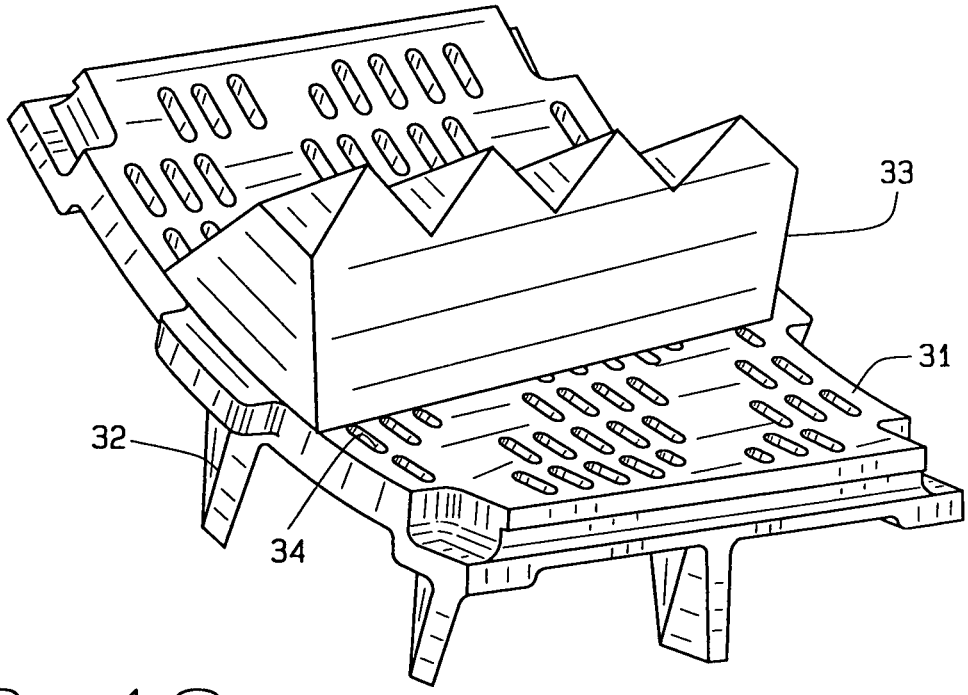
FIG. 12 is a perspective view of a liner segment showing the contoured rifling formed on its upper surface.

FIG. 12 discloses a liner segment 31 and as can be seen, these segments are similar to that as shown at 7, 18, and 22, and which form the interior surface of the main cylinder 2 of the unit. The contoured vane, as at 32, is integrally formed upon the outer surface of the segment 31, and contoured rifling 33 are provided upon the inner surfaces of the liner segments. Just like the contoured rifling 33, the vanes 32 may likewise have continuous angles upon their length, when these vanes are arranged intermediate the formed inner cylinder 2, and the outer cylinder 14, as shown in FIG. 4, for the dual cylindered tumbling unit. In this instance, the rifling and vanes are provided, and integrally cast, or fabricated upon the inner and outer surfaces of the shown liner segment 31. As also noted, there are the plurality of perforations 34 formed through each liner segment, particularly when a dual cylindered unit is being formed, so that the sand, debris, and other fines can fall through the liner segments, and into the outer cylinder, to be moved by the vanes 32, either towards the entrance end, or the outlet end, of the tumbling unit, for collection or disposal.

Figure 13:
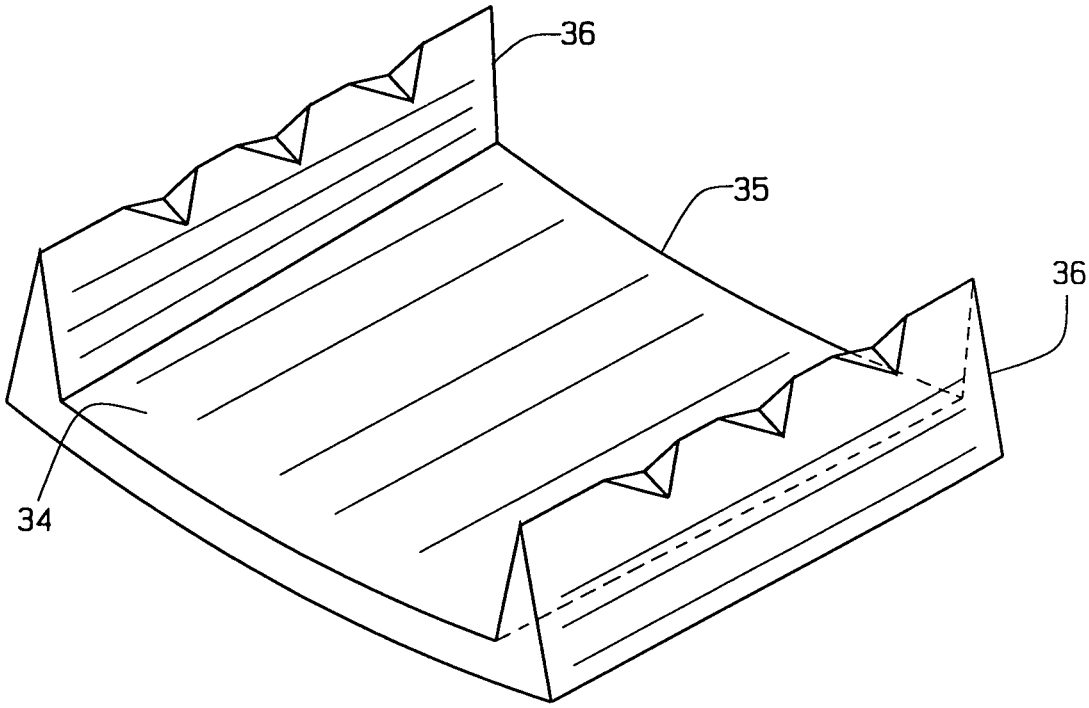
FIG. 13 shows a liner segment where one half of each contoured rifling is integrally formed at each side edge of the shown segments.

FIG. 13 shows the type of liner segment 35 that can be used for forming the singular cylinder 2 of the tumbling unit. Once again, the interiorly extending rifling can be located at the midpoint or ends of the liner segments, as noted in FIG. 12, or one half of each liner segment can be formed, as at 36, at each end edge of the segment 35, so that when a series of liner segments are assembled together, in a circumferential pattern, to form the interior of the cylinder 2, the complimentary half of the rifling of the adjacent liner segments will form a complete rifling, to function in the manner as described for the various liner segments as shown an explained for FIG. 5.

Figure 14:
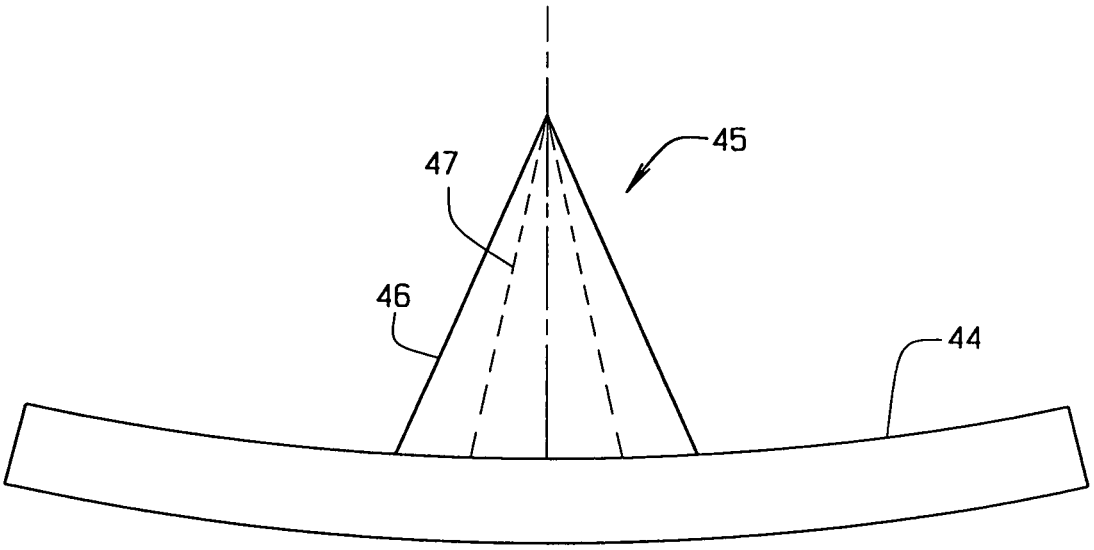
FIG. 14 is an end view of the contoured rifling shown in FIG. 11.

FIG. 14 shows a style of liner segment 44 for forming the inner lining of the cylinder 2, wherein the rifling 45 extends inwardly, generally at the midpoint of the shown segment 44. And, the intake end of the rifling, as at 46, is wider than the outlet end 47, so at to provide the degree of slope longitudinally, as previously explained, with respect to the contoured side 46 to 47 of the liner segment 44. Thus, there is a degree of slope, in this particular instance, as shown in FIG. 14, that extends from the inlet side to the outlet edge of the shown rifling, at the degrees selected when the liner segments are cast, in order to provide that degree of movement, speed of flow, and volumetric capacity for processing of castings within the tumbling unit, during its functioning. These may be the type of rifling as explained in FIG. 9, and as shown in section 2 of FIG. 5, for the assembled liner segments.

Figure 15:
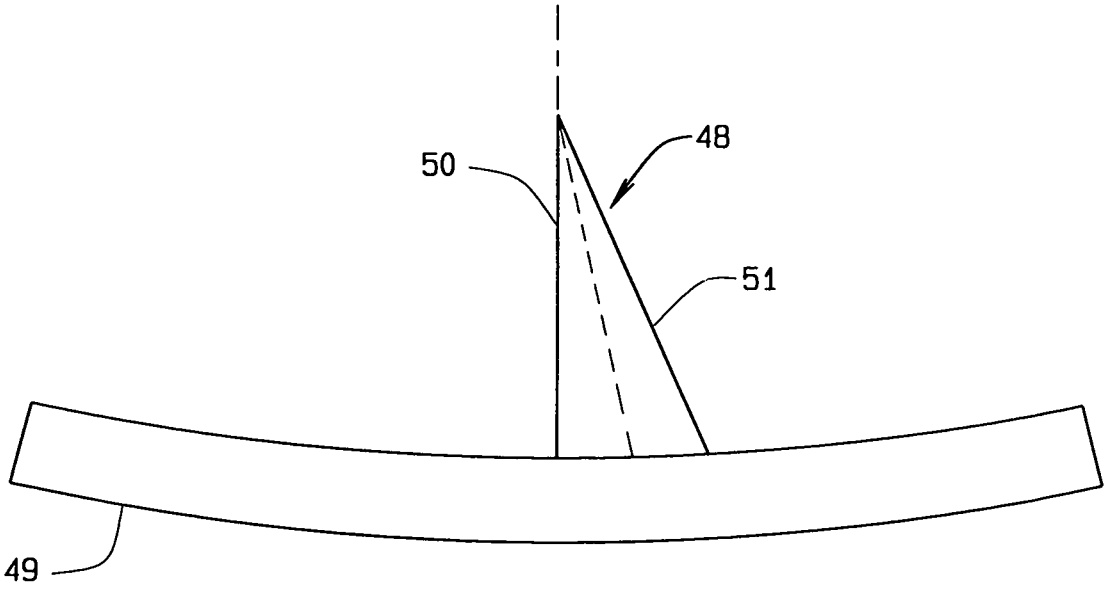
FIG. 15 is an end view of the contoured rifling shown in FIG. 10.

FIG. 15 shows the type of rifling, as at 48, formed upon the inner surface of the liner segment 49, and in this instance, this comprises the style of rifling as explained in FIG. 10, and as shown in the midsection 3 of the main cylinder as disclosed in FIG. 5. In this instance, one side of the rifling may be straight, as at 50, so as to simply tumble the castings as the cylinder is rotated in a clockwise direction, but the opposite side surface 51, will have an angulated contour, sloping towards the outlet end of the cylinder, so as to move the castings towards that end of the cylinder when it is rotated in a counterclockwise direction of movement.

Figure 16:
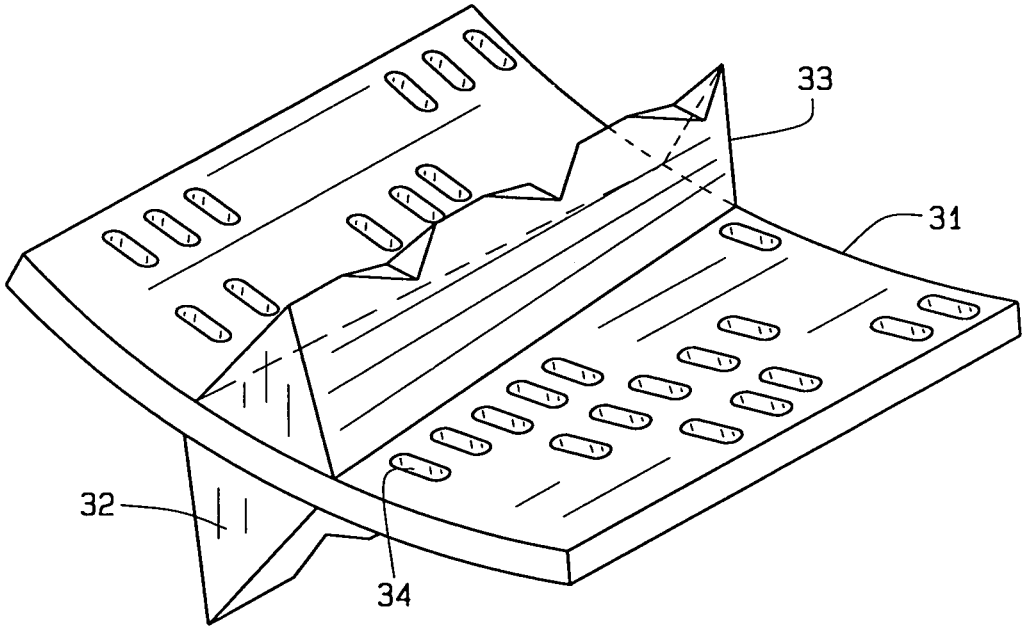
FIG. 16 is a perspective view of a liner segment having contoured rifling providing upon the inner surface and a contoured vane provided upon its outer surface, which when the liner segments are assembled into the formation of the inner cylinder, the contoured vanes locate intermediate the inner cylinder and the outer cylinder of the unit.

FIG. 16 shows a further variation upon a liner segment, similar to the liner segment 31, which forms the inner cylinder for the shake-out unit. It will have upon its inner surface integrally formed the rifling 33, as previously described, and which may have a contour, upon each side, along its length, somewhere between 0 to 15 degrees, or more, of slope. The slope is primarily along the length, in order to induce the metallics to be urged towards the outlet end of the unit, during application. But, in this instance, there will be a similar formed vane 37 integrally formed upon its intended outer surface, and that particular vane will have a similar shape, and be contoured as previously explained, along its length, just as the rifling 33 formed upon its inner surface of the liner segment 31. Thus, when the liner segments are formed into the inner cylinder or shell for the shake-out or sand reclaimer, a series of these outer vanes 37 will likewise be provided, for urging the sand or oxides in a particular longitudinal direction, at a specified quantity and capacity as desired by the operator, depending upon the direction of rotation of the unit, during its application and usage.

The foregoing are examples of the various designed configurations for the rifling, the vanes, the inlet vanes, for the tumbling unit of this invention. These specific degrees of slope particularly to the sides of the rifling, or the intermediate vanes, between cylinders, can be to various other angulated degrees, along the longitudinal axis of the unit, as previously explained, in order to provided for a controlled cleaning of the castings, metallics, products, or other elements to be cleaned within the tumbling unit. Obviously, other degrees of slope, along the longitudinal axis, for these components, may be designed into the tumbling unit, as may be determined most feasible for usage for the operations of the tumbling unit for the particular customer involved.

Variations or modifications to the subject matter of this invention may occur to those skilled in the art upon review of the disclosure as provided herein. Such variations, if within the spirit of this invention, are intended to be encompassed within the scope of any claims to patent protection issuing hereon. The description of the invention in the preferred embodiment, and its depiction within the drawings, are primarily set forth for illustrative purposes only.

We claim:

1. A multi-directional tumbling cylinder for use in the controlled movement and cleaning of products such as dross, salt cake, slag, or cast or molded metal pieces, comprising:

at least one cylinder having an inner surface, a length and a longitudinal axis, said cylinder capable of turning in a clockwise or counter-clockwise direction during usage, said length of cylinder having an intake end and outlet end;

a first section on the inner surface having a first liner segment having a first integral rifling having a first sloped lateral surface contoured inwardly toward the outlet end and a second sloped lateral surface contoured inwardly toward the outlet end, such that any castings or products deposited into the first section will move toward the outlet end regardless of whether the cylinder is turning in the clockwise or counter-clockwise direction;

a second section on the inner surface having a second liner segment having a second integral rifling having a first straight lateral surface which does not incline with respect to the longitudinal axis of the cylinder and a second sloped lateral surface, such that any castings or products deposited into the second section will tumble continuously in place when the cylinder is turning in the clockwise direction and any castings or products deposited into the second section will move toward the outlet end when the cylinder is turning in the counter-clockwise direction; and a third section on the inner surface having a third liner segment having a third integral rifling having a first sloped contour and a second sloped contour, such that any castings or products deposited into the third section will move to the second section when the cylinder is turning in the clockwise direction and any castings or products will move toward the outlet end when the cylinder is turning in the counter-clockwise direction.

2. The tumbling cylinder of claim 1, wherein said cylinder is rotated by an electric motor.

3. The tumbling cylinder of claim 2, wherein said electric motor is a variable speed motor.

4. The tumbling cylinder of claim 2, wherein said cylinder is roller mounted upon a base.

5. The tumbling cylinder of claim 4, wherein said roller is a roller bearing.

6. The tumbling cylinder of claim 1, wherein said tumbling cylinder is a sand reclaimer.

7. The tumbling cylinder of claim 1, wherein said tumbling cylinder is a casting shake-out unit.

8. The tumbling cylinder of claim 1, wherein said tumbling cylinder is a product separator for use in separating dross, salt cake, slag, or related products.

9. The tumbling cylinder of claim 1, wherein the second section on the inner surface further comprises another liner segment having a second integral rifling having a first straight lateral surface which does not incline with respect to the longitudinal axis of the cylinder and a second sloped lateral surface, such that any castings or products deposited into the second section will tumble continuously in place when the cylinder is turning in the clockwise direction and any castings or products deposited into the second section will move toward the outlet end when the cylinder is turning in the counter-clockwise direction.

10. The tumbling cylinder of claim 1, wherein the third section on the inner surface comprises another liner segment having a third integral rifling having a first sloped contour and a second sloped contour, such that any castings or products deposited into the third section will move to the second section when the cylinder is turning in the clockwise direction and any castings or products will move toward the outlet end when the cylinder is turning in the counter-clockwise direction.

11. The tumbling cylinder of claim 1, wherein the first sloped lateral surface of the first integral rifling of the first liner segment of the first section is sloped at seven degrees.

12. The tumbling cylinder of claim 1, wherein the second sloped lateral surface of the first integral rifling of the first liner segment of the first section is sloped at seven degrees.

13. The tumbling cylinder of claim 1, wherein the second sloped lateral surface of the second integral rifling of the second liner of the second section is sloped at seven degrees.

14. The tumbling cylinder of claim 1, wherein the first sloped contour of the third integral rifling of the third liner segment of the third segment has a slope of seven degrees.

15. The tumbling cylinder of claim 1, wherein the second sloped contour of the third integral rifling of the third liner segment of the third segment has a slope of seven degrees.

16. The tumbling cylinder of claim 1, wherein the first sloped lateral surface of the first integral rifling of the first liner segment of the first section is sloped at fifteen degrees.

17. The tumbling cylinder of claim 1, wherein the second sloped lateral surface of the first integral rifling of the first liner segment of the first section is sloped at fifteen degrees.

18. The tumbling cylinder of claim 1, wherein the second sloped lateral surface of the second integral rifling of the second liner of the second section is sloped at fifteen degrees.

19. The tumbling cylinder of claim 1, wherein the first sloped contour of the third integral rifling of the third liner segment of the third section is sloped at seven degrees.

20. The tumbling cylinder of claim 1, wherein the second sloped contour of the third integral rifling of the third liner segment of the third section is sloped at seven degrees.

21. The tumbling cylinder of claim 1, further comprising an entrance vane provided at said intake end of said cylinder, said entrance vane having at least one face extending angularly relative to the longitudinal axis of said cylinder, such that when said cylinder is rotated in one direction thereby forcing a volume of product into the cylinder for a tumbling process.

22. The tumbling cylinder of claim 21, wherein said entrance vane having an opposite face extending angularly within said cylinder, and said opposite face of the entrance vane having a different angular relationship with the longitudinal axis of the cylinder for providing a slower volumetric movement of product into the cylinder when said cylinder is rotated during performance of a tumbling process.

23. The tumbling cylinder of claim 22, wherein the faces of the entrance vane extending angularly longitudinally within said cylinder are of different angles to move different volumes of product into the cylinder for a tumbling process depending upon the direction of rotation of said tumbling cylinder during usage.

24. The multi-directional tumbling cylinder of claim 1, further comprising an outer cylinder, said outer cylinder encircling at least a portion of said at least one cylinder, a series of lengths of vanes provided between said one cylinder and said outer cylinder, said vanes disposed for movement of any residue product falling through said one cylinder and into the outer cylinder and moving the residue product towards the intake end or the outlet end of said tumbling cylinder for collection or disposal.

25. The tumbling cylinder of claim 1, wherein the first liner segment of the first section is interconnected to the second liner segment of the second section.

26. The tumbling cylinder of claim 1, wherein the second liner segment of the second section is interconnected to the third liner segment of the third section.

27. The tumbling cylinder of claim 1, wherein the first liner segment of the first section is perforated.

28. The tumbling cylinder of claim 1, wherein the second liner segment of the second section is perforated.

29. The tumbling cylinder of claim 1, wherein the first section on the inner surface further comprises another liner segment having a first integral rifling having a first sloped lateral surface contoured inwardly toward the outlet end and a second sloped lateral surface contoured inwardly toward the outlet end, such that any castings or products deposited into the first section will move toward the outlet end regardless of whether the cylinder is turning in the clockwise or counter-clockwise direction.

30. The tumbling cylinder of claim 29, wherein each integral rifling upon its first and second sloped lateral surfaces has an angular contour heightwise to regulate the tumbling of products during operations of said tumbling cylinder.

* * * * *